United States Patent [19]

O'Bryan

[11] 4,168,563

[45] Sep. 25, 1979

[54] SYSTEM FOR CARRYING OUT THE IN SITU CLEANING OF CARPET

[76] Inventor: LeRoy O'Bryan, 8001 Lewis Center, Westerville, Ohio 43081

[21] Appl. No.: 824,431

[22] Filed: Aug. 15, 1977

[51] Int. Cl.[2] ..... A47L 7/00

[52] U.S. Cl. ..... 15/321

[58] Field of Search ..... 15/302, 314, 320, 321

[56] References Cited

U.S. PATENT DOCUMENTS

| | | | |
|---|---|---|---|
| 2,531,370 | 11/1950 | Thompson | 15/321 |
| 2,571,575 | 10/1951 | Holmes | 15/321 X |
| 4,087,881 | 5/1978 | Bates | 15/321 X |

*Primary Examiner*—Christopher K. Moore
*Attorney, Agent, or Firm*—Millard, Cox & Smith

[57] ABSTRACT

A system, and apparatus for cleaning carpet and textile floor coverings which provides for a first detergent spraying followed by a second jet spraying with a liquid incorporating a cationic surfactant accompanied by a substantially simultaneous suctioning off of the deposited second liquid. The apparatus of the system includes a mobile frame arrangement with two adjacent tanks, one carrying cleaning solution and the other carrying the noted surfactant. Solenoid actuated valves control the delivery of these liquids through a wand to the carpet being cleaned. The apparatus includes a power conserving feature providing for a direct coupling between the motor of the apparatus and a suction blower and a simultaneous belt drive coupling to a liquid pump. The design of the apparatus is such as to minimize the physical effort required during its use. Among the features lessening the amount of this work effort is a semi-automatic tank filling arrangement including metering valves for adding proper amounts of liquid detergent and surfactant during the process.

9 Claims, 7 Drawing Figures

SYSTEM FOR CARRYING OUT THE IN SITU CLEANING OF CARPET

BACKGROUND

It is common knowledge that carpets which are cleaned regularly wear significantly longer than carpets permitted to carry traffic while soiled. Of course, regular cleaning additionally provides the advantage of improved appearance. Concerning the wear factors associated with the soiling of carpet, the particulate matter or dirt which develops within a carpet is abrasive in nature. Consequently, traffic over the dirty portions of a carpet tends to cause the abrasive matter to abraid the pile and backing thereof, thus shortening the effective lifespan of the material.

Inasmuch as carpeting now is used extensively in commercial applications as well as the home for purposes of background noise control as well as appearance, the square yardage of wall-to-wall carpet installation has assumed somewhat enormous proportions and has, concomitanly, led to demands for cleaning devices, the effectiveness of which extends beyond the capabilities of conventional domestic vacuum cleaners. Since it is impractical to remove carpeting for carrying out liquid based cleaning procedures, a veriety of somewhat portable devices have been proposed or introduced into the marketplace for providing in situ cleaning. Such devices, as may be exemplified in U.S. Pat. Nos. 4,019,218, 3,942,217; and 3,909,197, serve to discharge jets of pressurized cleaning solution into the pile, nap or weave of the carpet to be cleaned and, thereafter, apply suction to the nap for the purpose of withdrawing the dirt entraining cleaning solution (usually a water-detergent mixture) from the pile. Generally, the temperature of the liquid carrying the detergent is warm to hot, and in some devices, steam is developed for application to the carpet. Typical steam applicators are described, for example, in U.S. Pat. No. Re26,950. Application of liquid to the carpeting is carried out utilizing a handheld device conventionally referred to as a "wand". The head of this wand incorporates one or a plurality of nozzles for expelling detergent carrying liquid under pressure into the carpet as well as a suction arrangement which serves to rapidly remove the pressure-applied detergent-carrying liquid as well as entrained dirt particles. Such an arrangement is intended to avoid difficulties otherwise encountered in generating excessive moisture at the supporting strata of the carpet, i.e. mats or flooring positioned immediately beneath the carpet layer. Preferably, no significant amount of moisture remains in the carpet upon passing the wand implement thereover.

Depending upon the design, carpet cleaning devices of the high liquid pressure type under consideration, which currently are in the marketplace, evidence a variety of shortcomings both from the standpoint of their ability to treat the pile to an extent wherein a carpet surface of pleasant appearance results, as well as in the labor requirements encountered in their operation. For example, their utilization has been observed to require an excessive amount of physical exertion and to induce noticeable frustrations on the part of the operator thereof. This latter, labor intensifying aspect of the devices detracts from their profitability in that the square yardage of carpet cleaning capability of the devices becomes limited due to physical fatigue of the operator as well as in operational time lost in operator requirements for accommodating to the demands of the machine itself.

The difficulties encountered by operators in using current devices stem in part from the spatial structuring of components within the principal housings of the cleaning systems. Certain of the devices, for example as exemplified in U.S. Pat. No. 3,942,217, are more or less vertically structured to retain cleaning liquid tanks, an electric motor, liquid return receptors for the vacuum systems, pumps and blowers. Such vertical orientation requires the operator to fill the devices by lifting buckets of hot water to higher elevations to fill the detergent retaining tanks. When the devices subsequently are manipulated, for instance, down the hallway of an apartment building or along an office corridor, the heated water at such higher elevation tends to splash on the operator, thus frustrating performance efficiency. Further in this regard, where waste material return conduits and/or pressurized liquid conduits extend to the wand element from the forward end of such housings, manipulation of the entire cleaning paraphernalia becomes time consuming and difficult, inasmuch as the conduiting may extend for distances amounting to well over 100 feet. During the cleaning operation, the operator hand-manipulates the wand such as to pass it over the carpet in a reciprocatory fashion. Over a period of time, the operator's physical attitude or posture is one facing downwardly toward the carpet, a posture which becomes fatiguing over a period of use of the devices. Further in the above regard, while the devices or apparatus at hand may be considered somewhat portable, the power demands imposed upon their electrically powered motor or motors by water pumps and air blowers are significant. Inasmuch as only domestic-type power source outlets generally are available for operation of the machines, all too often overloading current demands are encountered by the operators causing the tripping of circuit breakers or blowing of fuses with a resultant operational down-time.

Now considering the cleaning performance of devices present in the marketplace, as noted above, the basis of their operation is to apply a generally hot water-born detergent or the like under relatively high pressure into the surface of the carpet. This material, now carrying dirt and abrasives from the carpet, is then supposed to be somewhat immediately picked up by the suction nozzle of the hand held wand of the apparatus. The resultant material is returned to a waste collection tank for ultimate disposal. While a significant amount of abrasive dirt and the like is removed in the course of this operation, a residue of the detergent material with entrained dirt particles does remain within the pile of the carpet following the cleaning procedure. Additionally, the procedure tends to build up the presence of a static charge within the carpet leading to undesirable surface effects. This static charge appears to cause an agglomerating effect in many carpet structures, again detracting from its appearance.

For certain carpet materials, for example, wool, the conventional suction devises utilized for water-detergent recovery, fail to remove an adequate amount of moisture following deposition thereof. In some instances, an interval of days may be required to fully dry the treated carpet, following which, as noted above, a residue of detergent is found to remain upon the carpet fibers.

SUMMARY

The present invention is addressed to an improved system, apparatus and method for carrying out the in situ cleaning of carpet. Characterized in providing a considerable improvement in cleaned carpet appearance, the inventive system effectively removes the surface deposited residue of detergent normally encountered following cleaning procedures as are carried out by prior art systems and devices. Of particular advantage, the system of the instant invention, while removing detergent residue, operates to remove process-deposited moisture with importantly improved effectiveness. With the system and method of the invention, the wand implement of the apparatus is manipulated to carry out a first cleaning pass over a carpet to be cleaned utilizing a pressure deposition of water and detergent along with a substantially simultaneous suction removal of the pressure deposited material. Following this initial procedure, the wand is manipulated to carry out a rinsing pass utilizing water combined with a cationic surfactant. The latter pass serves not only to effectively remove the above discussed detergent residue, but also, unexpectedly, is found to considerably improve overall moisture removal. The resultant clean carpet is found to be both static free and its appearance is improved by virtue of the removal of the detergent residue. Further the carpet exhibits an improved appearance with respect to the alignment of its fibers.

As another object and feature of the invention, the system thereof incorporates apparatus which permits a more efficient utilization of the labor expended by the operator. For instance, the spatial orientation of the liquid containing tanks supported upon the portable frame of the system with respect to motors, blowers and water pumps is such as to provide improved access to the implements thereof. Further, by arranging the motor of the device such that it provides for a direct drive input to the suction blower while simultaneously providing belt drive to the liquid pump of the apparatus, an improved power demand performance is achieved. With the latter performance, the apparatus of the system is less prone to cause the blowing of fuses or opening of circuit breakers in the course of use. Further in this regard, through the utilization of solenoid actuated valves in conjunction with the water pump of the apparatus and the dual liquid carrying tanks, considerable operator convenience in carrying out the first and subsequent second rinse pass utilized with the method of the invention is achieved. In one aspect, these solenoid driven valves are actuated from the vicinity of the wand implement of the apparatus. Another aspect of the system provides for the attachment of elongate hoses and the like at the rearward portion of the frame upon which all components are mounted. With such an arrangement, the operator is not required to move flexible hoses and conduiting as a preliminary step to moving the frame mounted tanks and motor driven components.

A further object of the invention is to provide a system for carrying out the in situ cleaning of carpeting which includes a frame which is moveable about the area of carpeting to be cleaned. Upon this frame are mounted a first tank for carrying a liquid born cleaning agent, such as a detergent, as well as a second tank suited for carrying a liquid born cationic surfactant. An electric motor is mounted upon the frame and is provided having an output drive shaft which extends along a given axis to provide a drive output directly to a suction blower also mounted upon the frame in juxtaposition with the motor and having its drive input shaft coupled and aligned in parallel axial relationship with the drive shaft of the motor. A liquid pump also is mounted upon the frame having liquid input and output ports for providing fluid at a pressure of at least one hundred p.s.i. and preferably at about 145 p.s.i. and which has an input drive shaft which is spaced transversely from in parallel axial relationship with the drive shaft of the motor. With such an arrangement, the pump, requiring less power for drive purposes particularly at start-up, is driven from a less efficient drive train, while the suction blower is driven by the most efficient connection available. Each of the liquid carrying tanks are coupled by flexible conduits with the pump input and discrete valves are coupled respectively with these liquid conveying conduits and are selectively actuated to permit the flow either of detergent containing liquid or surfactant containing liquid through elongate conduits leading to the wand device. A third tank, a vacuum tank, is mounted upon the frame in communication with the suction side of the blower and communicates with the conduits leading to the wand and providing suction at the head portion thereof. A manually actuable valve is provided at the handle of the wand to control the application of pressurized liquid therethrough.

Another feature and object of the invention provides an arrangement wherein the rinse and cleaning solution tanks may be filled conveniently from a hose input. Additionally, metering means are provided for the automatic addition of both detergent as well as cationic surfactant simultaneously with the introduction of liquid from the noted hose connection.

As another object, the invention concerns a method for carrying out the in situ cleaning of carpeting or textile floor covering comprising the steps of high pressure jet spraying, a mixture of water and detergent into the floor covering and substantially immediately thereafter vacuum suctioning off a substantial portion of that applied water and detergent. Subsequent to the latter step, a mixture of water and a cationic surfactant is sprayed by high pressure jet into the floor covering and substantially immediately thereafter the water present within the carpet as well as residual components of the detergent are removed by vacuum suctioning.

Other objects of the invention will, in part, be obvious and will, in part, appear hereinafter.

The invention, accordingly, comprises the system, arrangement of parts and method steps which are exemplified in the following detailed disclosure.

For a fuller understanding of the nature and objects of the invention, reference should be had to the following detailed description taken in connection with the accompanying drawings.

DETAILED DESCRIPTION

Figure 1:
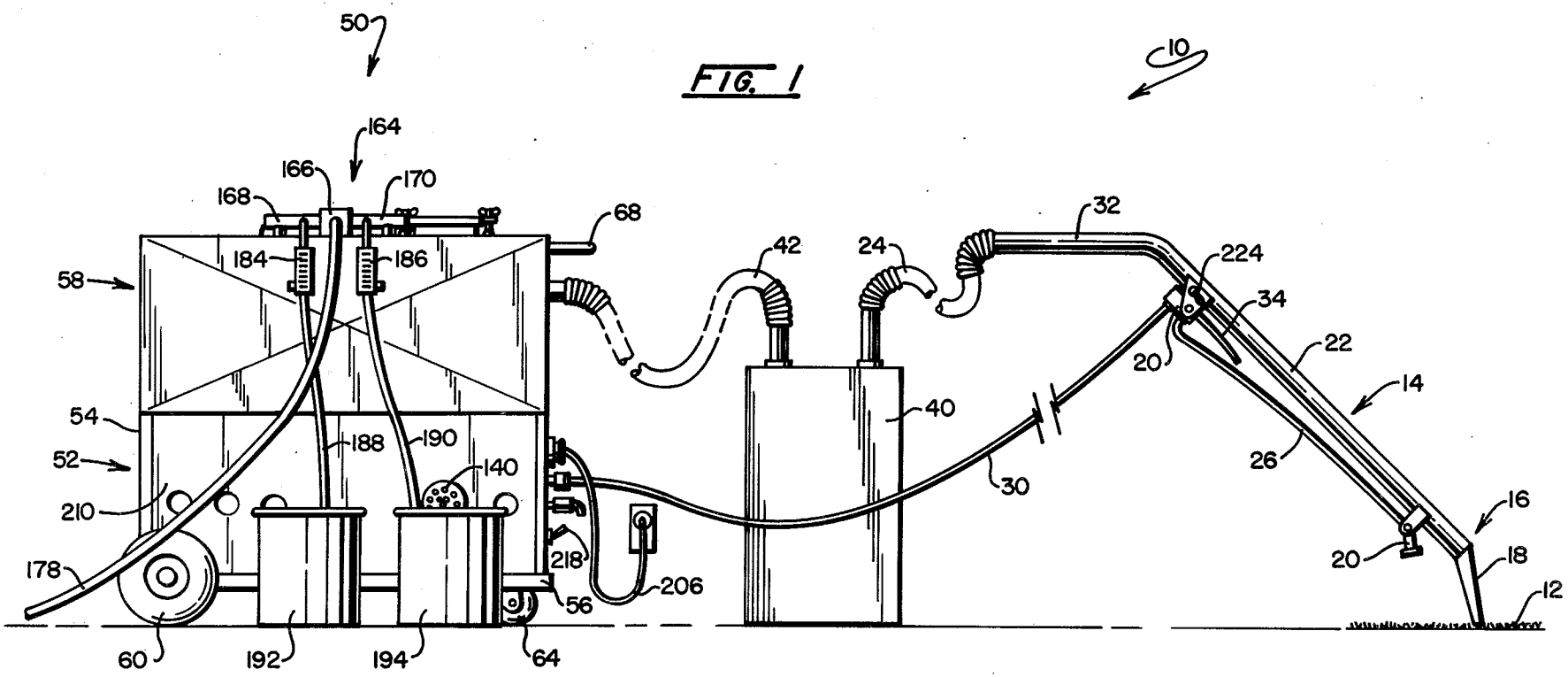
FIG. 1 is a side elevational view of the apparatus comprising the system of the invention.

Referring to FIG. 1, the components forming the carpet cleaning system of the invention are revealed. The figure shows a portion of wall-to-wall carpeting 12 in conjunction with the wand component 14 of the system. Wand 14 comprises a head 16 formed having a suction return mouth 18 and a plurality of high pressure nozzles 20, for example four. Mouth 18 communicates through a rigid conduit or tube 22 to an elongate flexible conduit 24 which ultimately is coupled to the input side of a suction blower.

Nozzles 20 communicate through a hose 26 to a hand actuated valve represented generally at 28. Valve 28 is rigidly coupled to tube 22 and, additionally, is connected by an elongate hose 30 to the frame supported portions of the system. The length of conduit 24 and tube 30 may be substantial. in practical operation. For example, for some applications a length of about 300 feet may be contemplated. It may be further noted, that the upward portion 32 of rigid conduit 22 is formed at an angle suited for its normally horizontal disposition in the course of use. This angular orientation of the conduit facilitates the hand manipulation of wand 14 as the operator moves it over carpet 12 in a reciprocatory motion. Without such arrangement at 32, the operator is called upon to assume a posture which may be characterized as somewhat leaning forwardly. In the course of a day's utilization of the system this could lead to early fatigue.

Wand 14 is used in conventional fashion, being drawn over a carpeting 12 while the operator depresses the leaver 34 of valve 28 to cause a water-detergent cleaning liquid to be sprayed at relatively high pressure into the pile of the carpet. Substantially immediately thereafter, the suction at mouth 18 draws this material back through conduits 22 and 24. Generally, a pressure of about 140 p.s.i. is desired at the nozzles 20. The effluvia picked up through mouth 18, including as much water and detergent as possible, initially is collected in a waste receptacle 40. Collection within receptacle 40 is conventional, the waste material and liquid carrier dropping by gravity to the lowermost regions of the receptacle, while the low pressure requisite for operating head 16 is maintained via flexible conduit 42 which leads to the blower component of the system. As is apparent, receptacle 40 may take a variety of shapes and includes an arrangement for disposing of the contents therein as well as for maintaining the air-tight integrity thereof.

Figure 2:
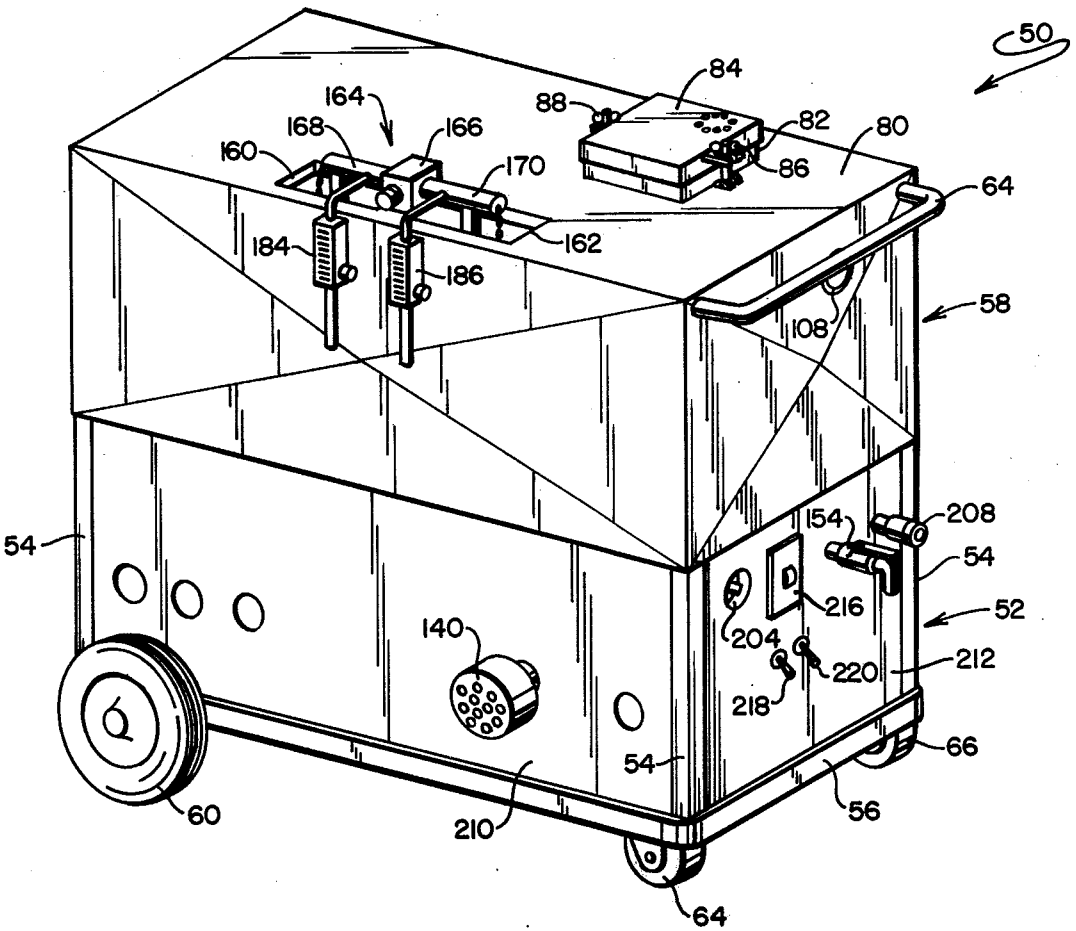
FIG. 2 is a perspective view of the frame and tank arrangement of the invention.

Referring additionally to FIG. 2, the frame mounted components of the system are revealed to establish a portable assembly shown generally at 50. Assembly 50 is formed of a lower frame 52 formed of vertically oriented angle members 54, one of each of which extends from a corner of the surface of a rectangular base 56. Connection of members 54 to base 56 preferably is by welding and members 54 extend to an upper, horizontally oriented frame portion (not shown) which serves to support a composite tank assemblage 58. Preferably, all of the above components, including base 56, members 54 and tank 58, are formed of stainless steel and are interconnected for rigidity by welding procedures or the like.

Figure 5:
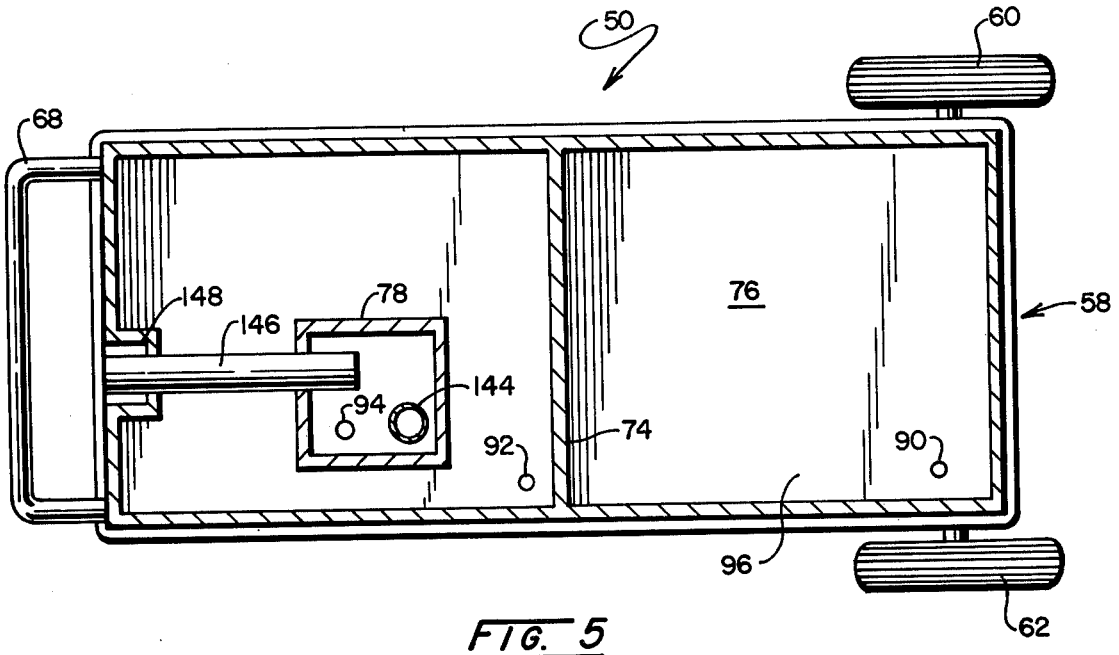
FIG. 5 is a plan sectional view of the apparatus of FIG. 4 taken through the plane 5—5 shown in that figure.

The portability of assembly 50 is provided by wheels 60 and 62 (see FIGS. 5 and 6) at the forward end thereof and by pivotal caster-type wheels 64 and 66 at the rearward end thereof. Additionally positioned at the rearward end of the assembly 50 is a U-shaped handle 68 attached by welding to the upper rear portion of composite tank assembly 58.

Figure 3:
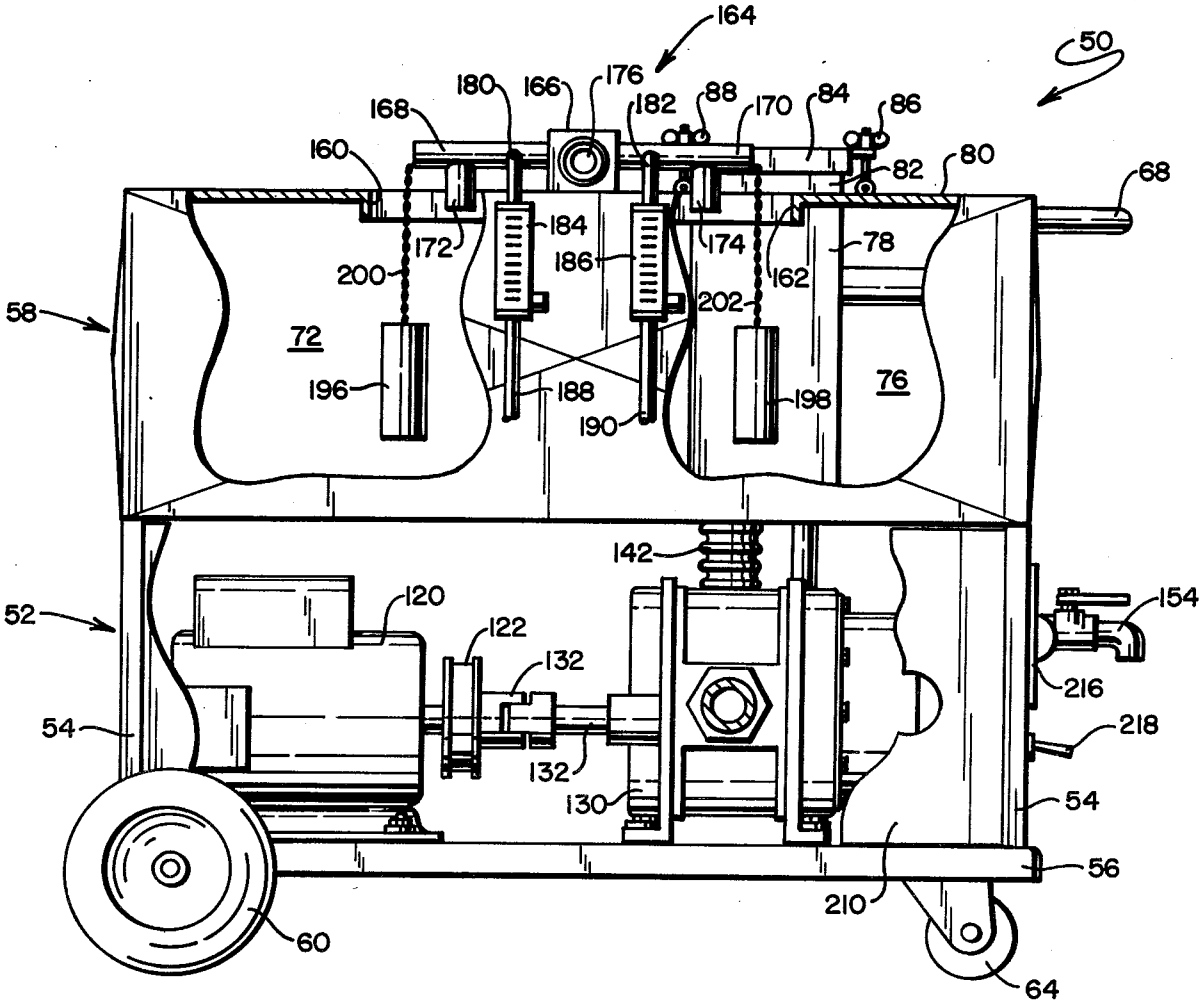
FIG. 3 is a right side view of the frame mounted components of the invention with portions broken away to reveal internal structure.
Figure 4:
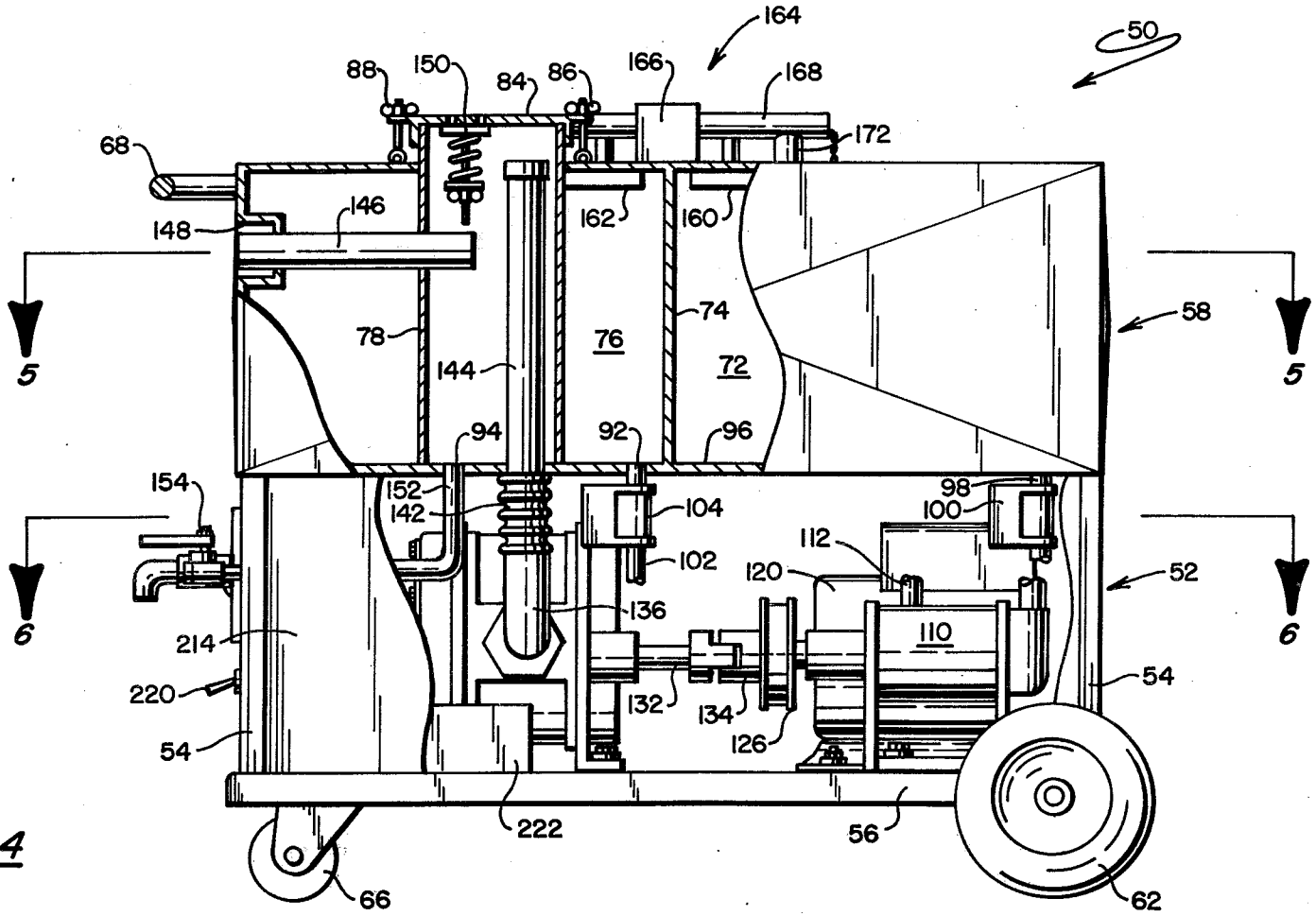
FIG. 4 is a left side elevational view of the frame mounted apparatus of the invention with portions broken away to reveal internal structure.

Referring to FIGS. 2-5, the structure and arrangement of composite tank assembly 58 is revealed in more detail. Assembly 58 preferably is formed of sheets of stainless steel and comprises a forwardly disposed tank 72 for retaining cleaning solution, i.e. warm or hot water in combination with a detergent. Tank 72, in turn, shares a common wall 74 with a secondary treating liquid tank 76. As noted above, this treatment serves both as a rinsing function for removal of detergent residue as well as a function enhancing the lifting of preapplied moisture from the carpet being cleaned. Tank 76 further includes a vacuum tank 78 having a rectangular cross section and which extends in somewhat elongate fashion through the upper stainless steel roof or cover 80 a relatively short distance, as at 82, for purposes of retaining a correspondingly rectangular cover or cap 84. Cover 84 is removable and, during operation of the device, is retained in position by bolt and wing-nut assemblies 86 and 88 which are pivotally fixed to upper cover 80 and slide within extended U-shaped brackets fixed to cover 84. As is revealed in FIGS. 4 and 5, conduit outflow communication with tanks 72, 76 and 78, respectively, is provided through apertures 90, 92 and 94 which extend through the bottom surface 96 of assembly 58. FIG. 4 further illustrates that aperture 90 is coupled with a pipe conduit 98 which extends to a solenoid actuated on-off valve 100. Similarly, aperture 92 extending from tank 76 is in outflow communication with a pipe or conduit 102 within which is coupled a similar, solenoid actuated on-off valve 104.

Figure 7:
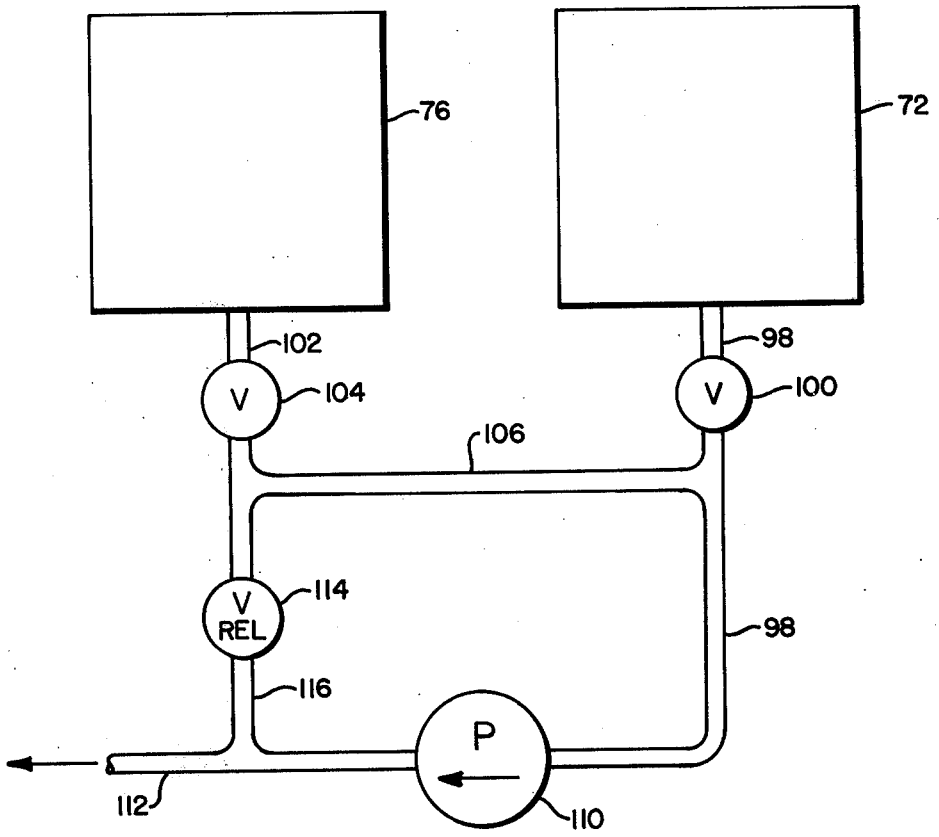
FIG. 7 is a schematic diagram of the valves and fluid conduits utilized in connection with the apparatus of FIG. 4.

Looking momentarily to FIG. 7, the fluid circuit within which valves 100 and 104 perform in conjunction with tanks 72 and 76 is schematically revealed. Note in the drawing that the output sides of each of the valves are commonly connected by a conduit 106. Accordingly, outflow from tank 76 passes valve 104 thence courses through conduit 106 to enter the input side of a pump designated 110. Pump 110 then drives the fluid under relatively high pressure of about 145 p.s.i. through output conduit 112 for ultimate connection to tube 30 as described earlier in connection with FIG. 1. A relief valve 114 coupled within conduit 116 communicates with output conduit 112 and with the common output connection 106 of valves 104 and 100. Should the operator actuate valve handle 34 of wand 14 to cut off liquid to nozzles 20, pressure relief valve 114 will open to protect pump 110. In this regard, the valve 114 is set to operate at about 150 p.s.i. or slightly above that level. Note, that by connecting relief valve 114 to the common output sides of solenoid actuated valves 100 and 104, only one relief implement is required for the protection of pump 110.

Figure 6:
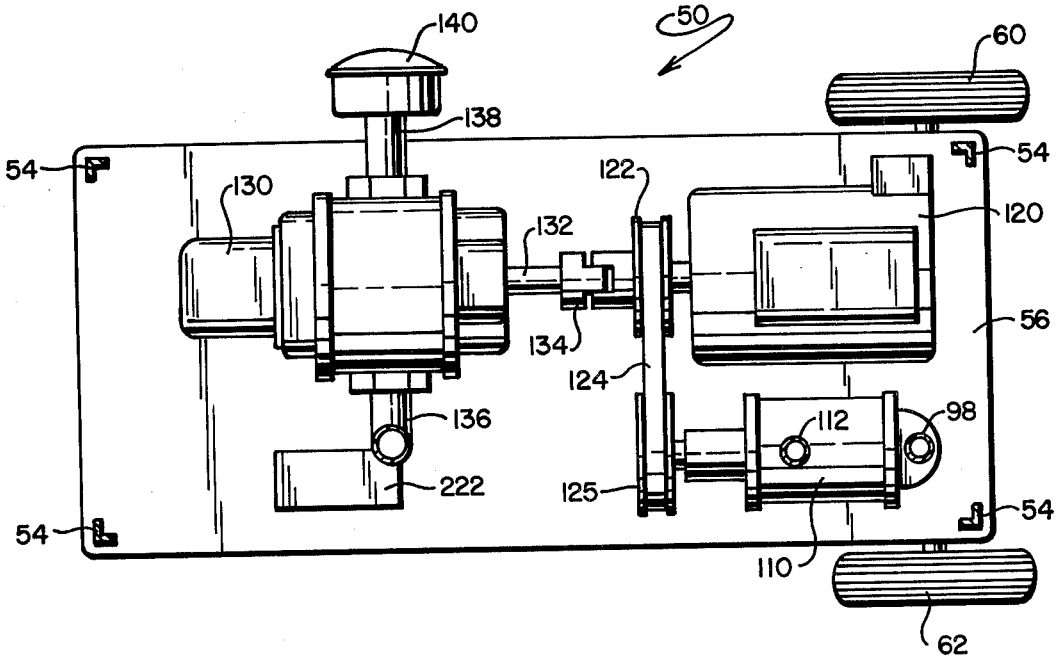
FIG. 6 is a top sectional view of the apparatus of FIG. 4 taken through the plane 6—6 thereof with portions deleted in the interest of clarity.

Looking to FIGS. 4 and 6, the drive to pump 110 is revealed in more detail. Pump 110 is mounted upon the surface of rectangular base 56 of the frame assembly 50 in adjacency with an electric motor 120. Note, that the drive shafts of motor 120 and pump 110 are in parallel axial relationship and that drive is imparted from the drive shaft of motor 120 through a pulley 122, V-belt 124 and driven pulley 126 coupled to the pump input shaft. This form of drive is provided within the instant system for purposes of conservation of current demands imposed by motor 120. While the V-belt and pulley drive arrangement is less efficient than a direct coupling, the power demands imposed by pump 110 are of lesser degree or level than the suction blower system. Further, during the period of greatest current demand, i.e. at motor start-up, the liquid carrying tubing of the system is in the process of being filled from pump 110 and the pressure initially generated is relatively low to, in turn, lower power requirements. Thus, the less efficient drive arrangement is associated only with pump 110.

Now considering the above-noted suction arrangement, FIGS. 3 and 6 reveal a suction blower 130 mounted upon base 56. Such blowers are available from a variety of sources, for example, an impeller actuated blower is marketed by Fuller Company, a subsidiary of General American Transportation Corp., Compton, California. Blower 130 is mounted such that its drive input shaft 132 is arranged in aligned parallel axial relationship with the corresponding axis of motor 120. Connection between the drive shaft of motor 120 and shaft 132 is provided by a flexible connector 134. This direct form of coupling is the most efficient mode of power communication between motor 120 and blower 130. Inasmuch as blower 130 imposes the highest demand for power of the entire system, its power demand relationship with motor 120 is thereby optimized. Estimates have been made that such direct coupling can result in power requirement savings of up to one third as compared with conventional belt drive.

Suction blower 130 is configured having a suction input conduit 136 and an output conduit 138 which leads to a conventional muffler 130. Looking additionally to FIGS. 4 and 5, suction input conduit 136 is coupled through a flexible hose-type connector 142 to a stand pipe type conduit or pipe 144. Pipe 144 has an open upper end and extends upwardly from bottom surface 96 to the upper region of suction tank 78. A suction return pipe extends across the upward region of tank 76 from the corresponding upper region of suction tank 78 to a cylindrically shaped recess 148 formed within the wall of tank 76. The outermost exposed portion of conduit 146 serves as a connector for attachment to flexible suction hose component 42 described earlier in connection with FIG. 1. The vacuum integrity of suction tank 78 is assured by the earlier-described cover or cap 84 and the degree of vacuum retained at the tank is adjustable by a spring actuated air valve mounted upon shaft 84 and represented at 150. Valve 150 operates in conjunction with small apertures formed within cap 84 (FIG. 2) and is manually adjustable by turning a wing-nut positioned at the bottom thereof. As is apparent, tank 78 forms a suction liquid return component operating in conjunction with earlier described waste receptable 40. Inasmuch as fluid eventually accumulates in the tank 78, a removal arrangement including aperture 94, pipe 152 and faucet 154 are provided. Further, a removable filter (not shown) generally is provided over the top of pipe 144.

As indicated earlier herein, an important aspect in the design of the instant system resides in the relative ease of its use by the operator. It may be observed from the foregoing discussion that the blower 130, pump 110 and motor 120 are positioned along the lowermost region of the frame 52. Additionally, the principle liquid carrying tanks 72 and 76 are mounted in close adjacency as a composite unit and directly above the power and pressurizing functions. The resultant structure is one having height which is convenient to access. In this regard, FIGS. 2 and 3 reveal the rectangular access openings into each of the liquid retaining tanks. For example, an opening 160 is formed in tank 72, while an adjacent, corresponding opening 162 is formed in tank 176. These openings are positioned at a level at which the operator can conveniently empty buckets of liquid containing surfactant or cleaning agent without undue strain. However, in accordance with the invention, an optional, more convenient arrangement for filling the tanks is provided.

Looking to FIGS. 1, 2 and 3, a semi-automatic filing arrangement is shown generally at 164. Apparatus 164 includes a manifold support 166 from the sides of which depend pipe-like conduits 168 and 170. Downwardly directed fill pipes 172 and 174 extend in fluid communication with respect to conduits 168 and 170. Support 166 also includes a quick disconnect hose coupling 176 which is connectable to an input feed hose as shown in FIG. 1 at 178. Additionally feeding into conduits 168 and 170 are the respective output conduits 180 and 182 of associated metering valves 184 and 186. The inputs to valves 184 and 186 are coupled respectively by flexible tubes 188 and 190 with pails or buckets 192 and 194. Pails 192 and 194 or their equivalent respectively may retain a liquid detergent and a cationic surfactant or fabric softener (FIG. 1).

Liquid movement from pails 192 and 194 through respective tubes 188 and 190, valves 184 and 186, and conduits 180 and 182 is by the venturi effect derived by liquid flow through respective pipes 168 and 170. Metering valves 184 and 186 provide an input of the proper liquid additive to an appropriate tank based upon the quantity and rate of flow of water passing along an associated conduit 168 and/or 170. The valves are marketed, for example, under the trade designation "Flow Meter", model F-41 by the D. W. Yer Corporation, Michigan City, Indiana. The particular quantity of liquid to be metered into the tanks 72 and 76 is adjustable by a hand manipulated valve on each of the flow meters and in accordance with the appropriate indicia marked on the outer face of each.

Control over the fill level in each of the tanks 72 and 76 is provided by level responsive switches (not shown) positioned within the outer extremity of each of the conduits 168 and 170. These switches are actuated by partially buoyant floats 196 and 198 suspended from the valves by respective chains 200 and 202. Such on-off float actuated valves, are marketed, for example, under a model designation No. 43421 by Dema, Corporation, St. Louis, Missouri.

As indicated in FIG. 1, tanks 72 and 76 are filled by attaching hose 178 between coupling 176 and either a hot water heater outlet or a cold water outlet.

FIGS. 1–4 additionally reveal certain surface mounted control features of the system. For example, a conventional female electrical power input is provided at 204 (FIG. 2) for connecting the system through a cable as at 206 (FIG. 1) to a conventional wall receptacle. FIGS. 1 and 2 reveal a quick disconnect hose coupling 208 for receiving one end of hose 30.

The lower portion of the portable assembly 50 is covered by four removable skirts as at 210, 212 and 214.

These skirts or panels preferably contain ventilation holes or may be formed of a material permitting air circulation about the motor and blower components. Skirt 212 (FIG. 2) generally is semi-permanently mounted such that it may support components such as faucet 154, connectors 208 and 204 as well as a power on-off switch and toggle switches 218 and 220. Switches 218 and 220 provide selective energization of the windings of the solenoids of solenoid control valves 100 and 104. Accordingly, switches 218 and 220 serve to control the operational mode of the device by providing for either the dispensation of liquid born detergent or a surfactant-containing rinsing solution. Alternately, the switches may be controlled at wand 14 by the operator through the manipulation of a double-pole switch mounted upon the wand as at 224. For purposes of protecting the circuitry leading to the powering function as well as associated with valve control, fuse components, electrical distribution components may be enclosed within a conventional coupling box as at 222 (FIGS. 4 and 6).

In the operation of the system 10, the assembly 50 is maneuvered to the vicinity of the area of carpeting to be cleaned. Movement of the apparatus 50 in this regard is facilitated, inasmuch as all depending lines including conduits as at 42, tubing 30, power cables 206 and the like are situated from a connection with the apparatus only from the rearward side thereof. Consequently, the elements tend to align themselves during movement, for example, along a hallway. The apparatus is filled by attachment of hose 178 to either a cold water outlet or the outlet of a hot water heater. A detergent cleaning liquid is placed in pail 192, while a cationic surfactant is placed in pail 194. As water passes through hose 178, it is distrubuted with an appropriate amount of additive into each of tanks 72 and 76. As these tanks become full, the level responsive valves within assembly 164 turns off the water supply.

Upon tank 72 and 74 being filled, the operator adjusts switches 218 and 220 and/or switch 224, if present, to provide for cleaning phase operation. The operator then actuates power switch 216 to energize motor 110. During this initial energization, power is supplied to the blower 130 as well as through a belt drive to water pump 110. Pump 110, however, has a lesser power demand at start-up inasmuch as the water carrying tubing as at 30 is in an empty condition and no back pressure is developed. The main power demand asserted by blower 130 is accommodated and the overall current demand of the powering system is retained within acceptable limits to avoid the blowing of fuses or releasing of circuit breakers.

The cleaning operation commences with the dispensation of a water-detergent cleaning solution. Accordingly, the operator actuates valve 28 and commences passing the head 116 of wand 14 over carpet 12. As this movement occurs, a high pressure jet spray of water and detergent issues from nozzles 20 into the carpet and as much as possible of the resulting mixture of water, detergent and dirt then is vacuum suctioned off substantially immediately. At the conclusion of so treating a given area of carpet 12, the operator manipulates either switch 224 or 220 to cause operation of the system in a rinsing mode or phase. Again, the wand 14 is manipulated over the carpet 12 and water containing a fabric softener is pressure jet sprayed from nozzles 20 over the area previously treated with detergent and water. This second pass provides two distinct advantages. First, that amount of residue of detergent which generally is not removed from carpet 12 with the initial pass now is removed. Secondly, the fabric softener within the rinsing liquid is observed to react with the moisture residue left within carpet 12 from the first phase of cleaning and now is more readily removed by suctioning through mouth 18 than was the case in removing liquid carrying a detergent cleaning additive. As another feature, the appearance of carpet 12 so cleaned is found to be superior with respect to carpets which are cleaned utilizing only a pass with a detergent carrying liquid and immediate suctioning of the dirt laden liquid.

Particularly where wool carpets and the like are involved, the removal of applied moisture from the carpets has in the past been found to be difficult, periods of days often being required to dry the carpeting. With the system and method of the instant invention, however, this is not the case, the requisite period for drying following application in two phases being significantly shorter. Another aspect developed with the use of the instant invention resides in the removal of static electricity within the carpet material itself. This removal is occasioned through the use of the fabric softener additive to the rinsing water.

Fabric softeners are cationic surfactants which may be formed having a relatively wide range of chemical structures and are reported to be true having ionizable organic salts. They ionize completely in dilute aqueous solution and will migrate under the influence of an imposed electric force. Their typically long alkyl or hydro-carbon chain is an integral part of the cation and they are sometimes known as invert soaps. Generally the major practical chemical grouping of the cationics are the tertiary amine salts and the quaternary ammonium salts, containing a pentavalent nitrogen atom. With their use, an improved lofting effect is derived in addition to the noted drying and antistatic effects. Further, the fibers of the textile treated tend to become self-lubricating thus improving wearability. For a more detailed discourse concerning fabric softeners, reference is made to the following publications which are incorporated herein by reference:

I. "Cationic Fabric Softeners", by DuBrow et al, Soap and Chemical Specialities, Vol. 33, No. 4, 1957, pp. 89–97.

II. "The Sorption of Synthetic Surface-Active Compounds by Textile Fibers," by Weatherburn et al, Textile Research Journal, Vol. 22, pp. 797–804.

Another feature concerning the full drying of carpet following the washing and surfactant rinse phases is available with the instant system. In this regard a third pass of wand 14 over the carpet may be carried out wherein hot air is blown through mouth 18 into the fibers thereof. With the instant apparatus, this hot air may be derived by coupling a hose as at 24, however of extended length, to the output of blower 130. As presently revealed, this output extends through muffler 140 to the atmosphere. A conventional pipe outlet muffler is utilized in place of muffler 140 and the hose is directly attached between the muffler output and wand 14. Accordingly, should the operator so desire a third air drying feature is available.

Since certain changes may be made in the above described system, method and apparatus without departing from the scope of the invention herein involved, it is intended that all matter contained in the description thereof or shown in the accompanying drawings shall be interpreted as illustrative and not in a limiting sense.

What is claimed is:

1. A system for carrying out the in situ cleaning of an area of carpeting or textile floor covering comprising:

a frame moveable about the said area;

a first tank mounted upon said frame for carrying a liquid borne cleaning agent;

a second tank mounted upon said frame for carrying a liquid-borne cationic surfactant;

motor means for providing a drive output mounted upon said frame and having an output drive shaft extending along a given axis;

suction blower means mounted upon said frame in juxtaposition with said motor means, having a drive input shaft coupled in aligned axial relationship with said motor means drive shaft axis for providing a vacuum deriving input and an exhaust output;

liquid pump means mounted upon said frame, having liquid input and an output for providing liquid at a pressure of not less than about 100 p.s.i. and having an input drive shaft spaced transversely from and in parallel axial relationship with said motor means drive shaft;

means for conveying rotational drive from said motor means drive shaft to said liquid pump means drive shaft at a rate deriving said liquid pressure;

first and second liquid conveying conduits coupled respectively between said first and second tanks and said liquid pump means input;

first and second valve means coupled respectively with said first and second liquid conveying conduits and selectively actuable to permit the flow therethrough of said liquid retained within a respective said first or second tank;

a vacuum tank mounted upon said frame and having an upper region and a lower region;

conduit means coupled with said vacuum pump input and said vacuum tank upper region;

means for removing liquid from said vacuum tank lower region;

a manumotive wand including a manually graspable handle coupled with a head configured for movement over and adjacent to said carpet or floor covering, said head including nozzle means for directing liquid under pressure for impingement upon the surface of said carpet or floor covering and a suction return mouth for removing said inpinged liquid;

liquid return means communicable between said wand and said vacuum tank for deriving a low pressure suction at said wand mouth;

flexible hose means connectable between said liquid pump means output and said nozzle means for conveying said liquid under pressure to said nozzle means; and manually actuable valve means connected with said flexible hose means and said wand for controlling the flow of said liquid under pressure.

2. The system of claim 1 including first and second solenoid means respectively operatively coupled with said first and second valve means and selectively energizable for selectively actuating said first and second valve means to effect the flow therethrough of said liquid retained within a respective said first or second tank.

3. The system of claim 2 including manually actuable switch means positioned upon said wand for selectively effecting actuation of said first and second valve means.

4. The system of claim 1 including:

manifold means for directing said water to flow into said tanks mountable adjacent said first and second tanks, connectable with a flexible conduit conveying a supply of water; and shut-off valve means mounted with said manifold means and responsive to liquid within said first tank attaining a predetermined level for selectively halting the said flow of water thereinto and responsive to liquid within said second tank attaining a predetermined level for selectively halting the said flow of water thereinto.

5. The system of claim 4 including first metering valve means having an input connectable with a supply of said cleaning agent and an output connected with said manifold means for providing a metered amount of said cleaning agent simultaneously with said water flowing into said first tank.

6. The system of claim 4 including second metering valve means having an input connectable with a supply of said cationic surfactant and an output connected with said manifold means for providing a metered amount of said surfactant simultaneously with said water flowing into said second tank.

7. The system of claim 1 including:

manifold means for directing said water to flow simultaneously into said first and second tanks mountable upon and intermediate said first and second tanks and connectable with a flexible conduit conveying a supply of water;

first and second shut-off valve means mounted upon said manifold means and respectively responsive to the level of liquid in said first and second tanks for selectively halting the flow of said water thereinto.

8. The system of claim 1 in which said first and second tanks are configured in side-by-side mutual adjacency and are combined with said vacuum tank as a composite assemblage; and said motor means, said suction blower means and said liquid pump means are mounted at a common planar elevation upon said frame beneath said composite tank assemblage.

9. The system of claim 1 including pressure responsive valve means coupled between said liquid pump means output and each said first and second liquid conveying conduits intermediate said first and second valve means and said pump means input, for effecting the automatic recirculation of liquid from said pump means output to said pump means input upon actuation of said manually actuable valve means to terminate said flow of said liquid.

* * * * *